United States Patent [19]

Giacometti

[11] Patent Number: 4,811,093

[45] Date of Patent: Mar. 7, 1989

[54] SYSTEM FOR ADJUSTING THE RELATIVE ANGULAR POSITIONS OF TWO VIDEO CAMERAS DIRECTED TOWARDS THE SAME OBJECT AND APPLICATION THEREOF TO THE ADJUSTMENT OF THE ORIENTATION OF TWO APPARATUS

[75] Inventor: Emmanuel Giacometti, Pelissanne, France

[73] Assignee: Société Anonyme dite: Aerospatiale Societe Nationale Industrielle, Paris, France

[21] Appl. No.: 79,222

[22] Filed: Jul. 29, 1987

[30] Foreign Application Priority Data

Jul. 31, 1986 [FR] France ..... 86 11130

[51] Int. Cl.[4] ..... H04N 7/18

[52] U.S. Cl. ..... 358/106; 358/88; 358/92; 358/105

[58] Field of Search ..... 358/88, 92, 105, 106

[56] References Cited

U.S. PATENT DOCUMENTS

| | | | |
|---|---|---|---|
| 2,417,446 | 3/1947 | Reynolds | 358/92 |
| 3,705,261 | 12/1972 | Langley | 358/88 |
| 3,811,010 | 5/1974 | Long | 358/105 |
| 4,713,685 | 12/1987 | Nishimura | 358/133 |

*Primary Examiner*—Howard W. Britton

*Attorney, Agent, or Firm*—Marshall, O'Toole, Gerstein, Murray & Bicknell

[57] ABSTRACT

This invention relates to a system for adjusting the relative angular positions of two video cameras directed towards the same object, characterized in that it comprises:—structure for synchronizing the actions of said cameras;—structure for displaying the video signals issuing from said cameras, these display structures being common to said cameras;—and a device for addressing to said display structure a succession of images which come, alternately, from one and the other of said cameras. The system of the invention is more particularly applicable to the adjustment of the axes of two apparatus, for example the firing axis of a weapon and the axis of sight of a viewfinder.

10 Claims, 3 Drawing Sheets

SYSTEM FOR ADJUSTING THE RELATIVE ANGULAR POSITIONS OF TWO VIDEO CAMERAS DIRECTED TOWARDS THE SAME OBJECT AND APPLICATION THEREOF TO THE ADJUSTMENT OF THE ORIENTATION OF TWO APPARATUS

The present invention relates to a system for adjusting the relative angular positions of two video cameras directed towards the same object, and to the application thereof to the adjustment of the orientation of two apparatus. More particularly, it makes it possible to adjust the shot-taking axes of two video cameras towards the same object, as well as to adjust the axes of said apparatus towards said object.

It is an object of the present invention to indicate a simple, inexpensive means which does not require any complex electronic or dataprocessing apparatus.

To this end, according to the invention, the system for adjusting the relative angular positions of two video cameras directed towards the same object, is noteworthy in that it comprises:

means for synchronizing the actions of said cameras;

means for displaying the video signals issuing from said cameras, these display means being common to said cameras; and means for addressing to said display means a succession of images which come, alternately, from one and the other of said cameras.

In this way, in the succesion of video images displayed on said display means, all the even-row images come from one of the cameras, whilst all the odd-row images come from the other of said cameras. Two images therefore appear on the screen of said display means, of which one is constituted by the succession of the even-row video images and of which the other is formed by the succession of said odd-row video images. Consequently, if he relative angular positions of the two cameras with respect to the same object are not identical, two images of this object appear on said screen, which are distinct from each other. On the other hand, if these relative angular positions of the two cameras are identical, these two images are exactly superposed to form one image. At the moment of superposition of said images, on the one hand, the two cameras occupy the same angular positions about their shot-taking axes and, on the other hand, the axes of said cameras are strictly parallel, if the object aimed at is at infinity, or converge at the location of said object if the latter is at a finite distance.

In order to be able to obtain superposition of the two images on the screen of the display means, at least one of said cameras is mounted in orientable manner with respect to a support. Although, in the system according to the invention, the two cameras may be mounted in orientable manner with respect to their respective support, it is advantageous, for the purpose of simplicity of manoeuvring in order to obtain superposition of the images on said screen and therefore the desired adjustment of the axes of the cameras, if one of said cameras is mounted rigidly on a support oriented towards said object, so that the orientation of this camera about its shot-taking axis and this shot-taking axis serve respectively as corresponding references for the other camera.

In an advantageous embodiment of the invention, said means addressing to the display means the images of the two cameras comprise an image commutation device provided with two inputs respectively receiving the video signals of said cameras and with a single output connected to said display means, said image commutation device being adapted to take one or the other of two alternate positions of which one connects one of said inputs with said output and the other connects the other of said inputs with this output, at the rhythm of the synchronization pulses of said video images. Said image commutation device is preferably controlled by a monostable multivibrator, of which the input receives the succession of the synchronization pulses of the video images and of which the output controls the alternate tipping of said commutation device from one of its positions to the other.

The system according to the invention may be used in numerous fields of application, in particular in order to adjust the axes of two apparatus with respect to each other, as well as the orientations thereof about said axes, these apparatus being for example a viewfinder and a weapon offset with respect to said viewfinder.

To this end, according to the invention, the system for adjusting the relative angular positions of two apparatus towards the same object, is noteworthy in that it comprises:

a first video camera rigidly connected to the first of said apparatus so that its shot-taking axis is at least substantially merged with the axis of said first apparatus;

a second video camera rigidly connected to the second of said apparatus so that its shot-taking axis is at least substantially merged with the axis of said second apparatus;

means for synchronizing the actions of said cameras;

means for displaying the video signals issuing from said cameras, these display means being common to said cameras; and means for addressing to said display means a succession of images which come alternately from one and the other of said cameras.

It follows from the foregoing that in order to obtain adjustment of the axes of said first and second apparatus with respect to each other (such adjustment bringing about parallelism of said axes if the object aimed at by said cameras is at infinity, or a convergence of said axes on said object if the latter is located at a finite distance), as well as adjustment of the relative angular positions of said apparatus about their axes, it suffices to bring the two images furnished by the cameras into superposition on the screen of said display means.

To this end, at least one of said apparatus is mounted in orientable manner with respect to a support, so that the apparatus-camera assembly may be oriented as a unit.

Of course, in this system for adjusting the relative positions of the two apparatus, said means addressing to the display means the images of the two cameras may comprise the particular features set forth hereinabove.

The video cameras may be of any known type, such as the scanning type as far as the conventional television cameras are concerned, and thermal cameras with infrared detectors or CCD cameras. One of said cameras is advantageously provided, at the start, with a synchronization device enabling it to synchronize a slave camera.

The invention will be more readily understood on reading the following description with reference to the accompanying drawings, in which.

Figure 1:
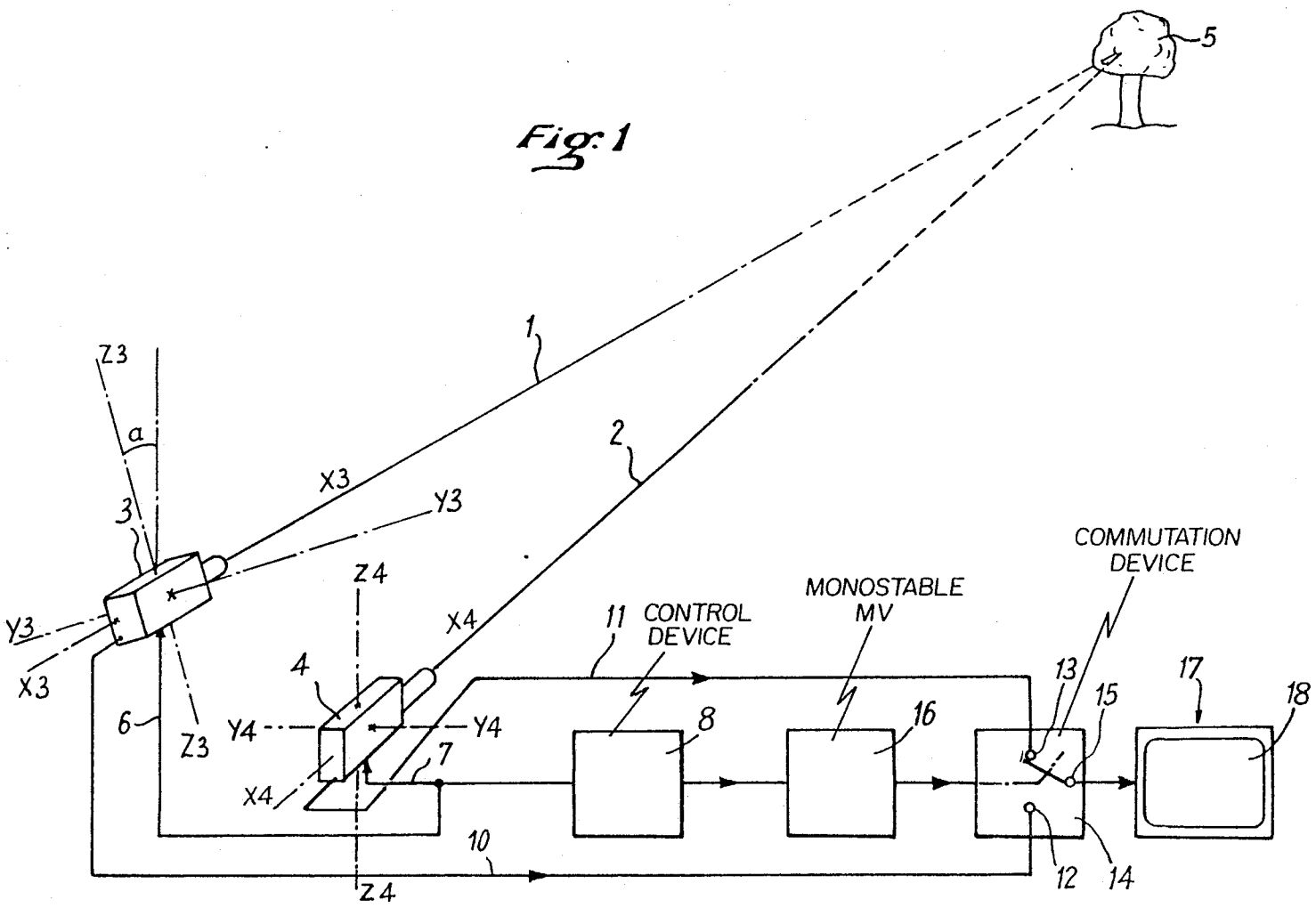
FIG. 1 is a schematic view, partly in perspective, of the system for adjusting the relative angular positions of two video cameras, according to the invention.
Figure 3A:
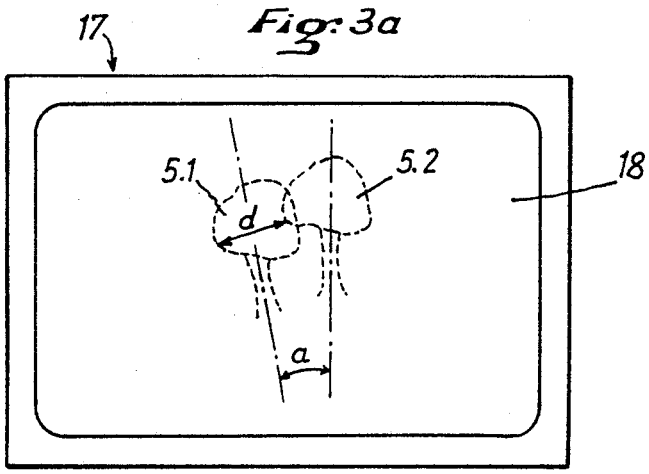
Figure 3B:
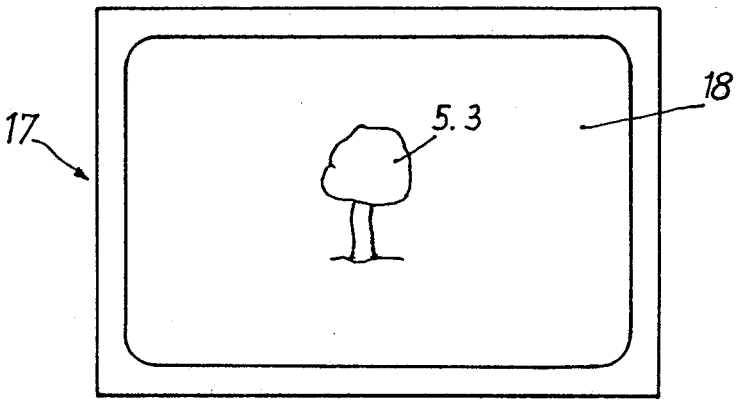

FIGS. 3*a* and 3*b* illustrate the images appearing on the display screen of the system of FIG. 1.

Figure 4:
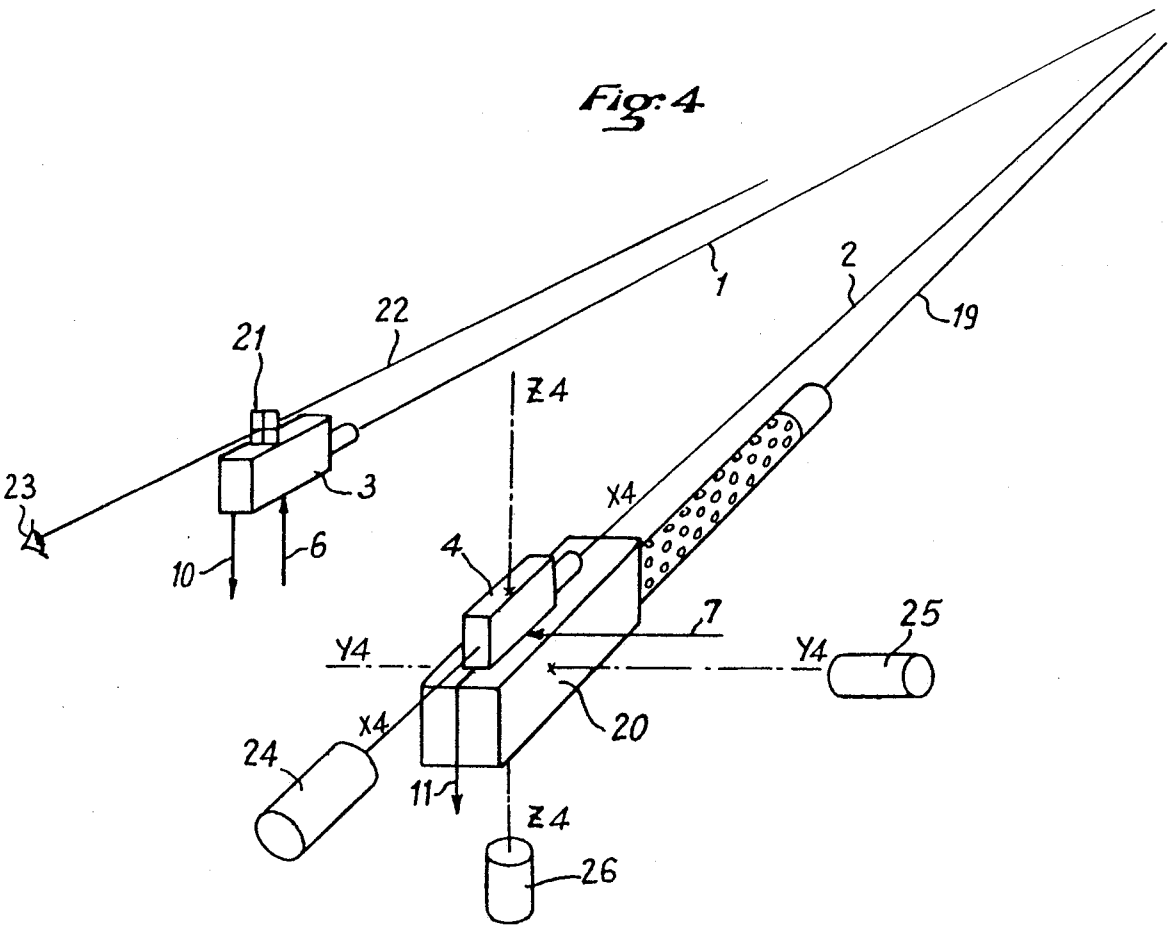

FIG. 4 shows an application of the system of FIG. 1.

Referring now to the drawings, the system according to the invention, shown in FIG. 1, has for its object to adjust with respect to each other the relative angular positions, and in particular the shot-taking axes 1 and 2 of two video cameras 3 and 4 respectively. Cameras 3 and 4 are directed at least substantially towards the same object (or group of objects) 5, for example a tree on a landscape, with the result that said axes 1 and 2 are parallel to each other if said object 5 is very far or are convergent at the location of said object if the latter is at a finite distance from the two cameras 3 and 4.

Figure 2:
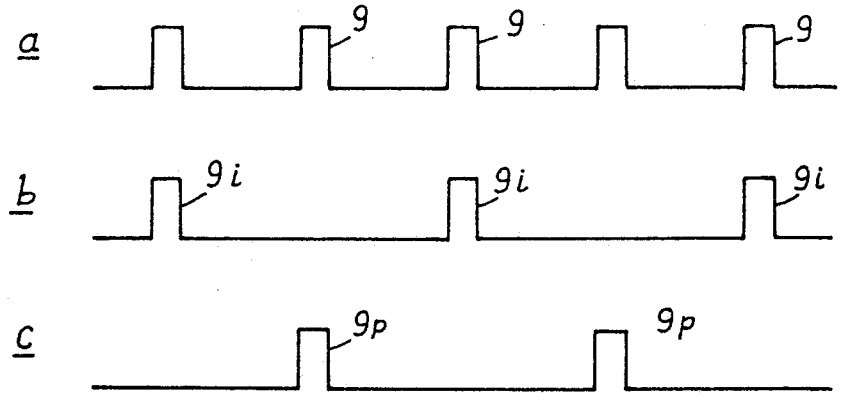
FIG. 2 shows timing charts a, b and c illustrating the operation of the system of FIG. 1.

By links 6 and 7 respectively, the two cameras 3 and 4 are controlled in strict synchronism by an electronic control device 8. In particular, this electronic control device 8 addresses to cameras 3 and 4, via said links 6 and 7, the same image synchronization pulses 9 (cf. chart a of FIG. 2).

The video signals generated by said cameras 3 and 4 appear at the respective outputs 10 and 11 thereof. These outputs 10 and 11 are connected to two inputs 12 and 13 of a commutation device 14, with single output 15.

Between the control device 8 and the commutation device 14 there is disposed a monostable multivibrator 16, receiving at its input the image synchronization pulses (FIG. 2*a*) generated by the electronic control device 8. The output of the monostable multivibrator 6 controls tipping of the commutation device 14, with the result that, the output 15 is connected with input 12 and with input 13, alternately. In this way, for odd-row pulses 9 (for example), bearing reference 9*i* in FIG. 2*b*, a link is established between the input 12 and the output 15. On the other hand, for the even-row pulses 9 (for example), bearing reference 9*p* in FIG. 2*c*, the link is established between the input 13 and the output 15. This results in that, at the output 15, it is the images of camera which appear for pulses 9*i* and images of camera which appear for pulses 9*p*.

In this way, the signal at output 15 of the commutation device 14 is constituted by two succession of interlaced images, coming respectively from cameras 3 and 4, the images of each succession following one another at a frequency (that of pulses 9*i* or 9*p*) half of that of image synchronization signals 9.

In FIG. 1, for the purposes of clarity, there is associated with each of the cameras 3 and 4 a system of reference axes X3, Y3, Z3 and X4, Y4, Z4 respectively. For example, axes X3 and X4 respectively merge with axes 1 and 2 and the axes of the two systems of axes correspond to one another in two's.

If the signal appearing at output 15 of the commutation device 14 is addressed to a display device 17, provided with a screen 18, two cases may arise:

if axes 1 and 2 of the two cameras 3 and 4 are not strictly parallel (object 5 at infinity) or do not converge exactly on the object 5 (object 5 at a finite distance), and/or if the angular positions of the two cameras 3 and 4 about axes 1 and 2 are not identical, there appear on the screen 18 two images 5.1 and 5.2 of the object (FIG. 3*a*). These images 5.1 and 5.2 are offset with respect to each other by a distance d corresponding to the amplitude of the relative defect in alignment of said axes 1 and 2 and or are inclined with respect to each other by an angle a corresponding to the difference in angular position about said axes 1 and 2. Said images 5.1 and 5.2 each present a repetition frequency equal to half the video images furnished by each of the cameras 3 and 4;

if axes 1 and 2 of the two cameras 3 and 4 are strictly parallel or converge exactly at the same point of the object 5 and if the angular positions of the two cameras 3 and 4 about axes 1 and 2 are identical (FIG. 3*b*), the two images 5.1 and 5.2 are superposed and form a single image 5.3 of object 5, this image being constituted alternately by video images coming from camera 3 and by video images coming from camera 4, these video images being interlaced and communicating to image 5.3 a repetition frequency equal to the frequency of the image synchronization pulses 9.

In order to adjust the relative orientation of the cameras 3 and 4 with respect to each other, it thus suffices to modify the orientation of at least one of said cameras until the superposition of images 5.1 and 5.2 on the screen 18 is obtained, i.e. single image 5.3.

If, for example, the position of camera 3 is considered as giving the reference position, it is only necessary that camera 4 be mobile with respect to its support (not shown) about axes X4, Y4 and Z4. The articulation of camera 4 (and possibly that of camera 3) with respect to said support may be of any known type and is therefore not shown.

FIG. 4 shows an example of application of the system of FIG. 1 to the adjustment of a weapon 20 having a line of fire 19, this weapon 20 being offset laterally with respect to a viewfinder 21, of which the line of sight bears reference 22. Such a configuration of a weapon system is currently to be found on board aircraft, particularly helicopters, in which the viewfinder 21 lies opposite the pilot or copilot, represented in the Figure by eye 23, whilst the weapon 20 is offset laterally.

Upon assembly or change of the weapon 20 and/or of viewfinder 21, it is necessary to adjust the respective angular positions of these apparatus and, in particular, to adjust axes 19 and 22. It is also necessary to proceed from time to time with adjustments in order to compensate and eliminate the losses of adjustment occurring.

In the device of FIG. 4:

the viewfinder 21 is fast with camera 3 and the shot-taking and sighting axes 1 and 22 are sufficiently close and parallel to be able to be considered as merged;

camera 4 is fast with weapon 20 and the shot-taking and firing axes 2 and 19 are sufficiently close and parallel to be able to be considered as merged;

at least the assembly of weapon 20 and of camera 4 may be oriented about rectangular axes X4, Y4 and Z4, respectively, by means of screw jacks 24, 5 and 26.

In this way, when it is necessary to be sure of the alignment between the axes 19 and 22 of weapon 20 and of viewfinder 21 (which may take into account the lateral offset of weapon 20), as well as the relative orientation thereof about said axes, the images 5.1 and 5.2 given by cameras 3 and 4 are examined on screen 18. If these images merge to form image 5.3, no adjustment i necessary. If, on the contrary, two images 5.1 and 5.2 appear, one or more of the screw jacks 24, 25, 26 are actuated in order to modify the orientation of the assembly 4-20 so as to obtain only one image 5.3. At that moment, adjustment is terminated.

The finite or infinite distance separating object 5 from cameras 3 and 4 is chosen as a function of the characteristics of the weapon 20.

What is claimed is:

1. A system for adjusting the relative angular positions of two video cameras directed towards the same object, comprising:

means for synchronizing the actions of said cameras;

means for displaying the video signals issuing from said cameras, these display means being common to said cameras; and means for addressing to said display means a succession of images which come, alternately, from one and the other of said cameras, the image from one of said cameras being an even-row image, and the image from the other of said cameras being an odd-row image, said images being interlaced in said display means and forming a single view of said object when both of said cameras are directed towards the object.

2. The system of claim 1, wherein at least one of said cameras is orientable.

3. The system of claim 2, wherein one of the cameras is fixed, whilst the other is orientable.

4. The system of claim 1, wherein said means addressing to the display means the images of the two cameras comprise an image commutation device provided with two inputs respectively receiving the video signals of said cameras and with a single output connected to said display means, said image commutation device being adapted to take one or the other of two alternate positions of which one connects one of said inputs with said output and the other connects the other of said inputs with this output, at the rhythm of the synchronization pulses of said video images.

5. The system of claim 4, wherein said image commutation device is controlled by a monostable multivibrator, of which the input receives the succession of the synchronization pulses of the video images and of which the output controls the alternate tipping of said commutation device from one of its positions to the other.

6. A system for adjusting the relative angular positions of two apparatus towards the same object, comprising:

a first video camera rigidly connected to the first of said apparatus so that its shot-taking axis is at least substantially merged with the axis of said first apparatus;

a second video camera rigidly connected to the second of said apparatus so that its shot taking axis is at least substantially merged with the axis of said second apparatus;

means for synchronizing the actions of said cameras;

means for displaying the video signals issuing from said cameras, these display means being common to said cameras; and means for addressing to said display means a succession of images from one and the other of said cameras, the image from one of said cameras being as even-row image, and the image from the other of said cameras being an odd-row image, said image being interlaced in said display means and forming a single view of said object when both of said cameras are directed towards the object.

7. The system of claim 6, wherein at least one of the apparatus-camera assemblies is orientable.

8. The system of claim 7, wherein one of the apparatus-camera assemblies is fixed, whilst the other apparatus-camera assembly is orientable.

9. The system of claim 6, wherein said means addressing to the display means the images of the two cameras comprise an image commutation device provided with two inputs respectively receiving the video signals from said cameras and with a single output connected to said display means, said image commutation device being adapted to take one or the other of two alternate positions of which one connects one of said inputs with said output and the other connects the other of said inputs with this output, at the rhythm of the synchronization pulses of said video images.

10. The system of claim 9, wherein said image commutation device is controlled by a monostable multivibrator of which the input receives the succession of the synchronization pulses of the video images and of which the output controls the alternate tipping of said commutation device from one of its positions to the other.

* * * * *